United States Patent [19]

Borzoni

[11] Patent Number: 4,608,548

[45] Date of Patent: Aug. 26, 1986

[54] MINIATURE FUSE

[75] Inventor: John Borzoni, Des Plaines, Ill.

[73] Assignee: Littelfuse, Inc., Des Plaines, Ill.

[21] Appl. No.: 688,956

[22] Filed: Jan. 4, 1985

[51] Int. Cl.[4] ..... H01H 85/02

[52] U.S. Cl. ..... 337/201; 337/186; 337/231; 337/232

[58] Field of Search ..... 337/201, 186, 213, 227, 337/231, 232, 234, 238, 241, 246, 248, 260, 261, 262, 263, 255

[56] References Cited

U.S. PATENT DOCUMENTS 4,511,875 4/1985 Arikawa ..... 337/201

*Primary Examiner*—Harold Broome

*Attorney, Agent, or Firm*—Russell E. Hattis; Stephen R. Arnold

[57] ABSTRACT

A miniature electrical fuse designed for at least 60 volt circuit applications in printed circuit application features protection against housing explosion under fuse blowing conditions by means of arc barrier-forming shroud members formed by confronting rigid arc barrier walls of base and cover members between which end terminals of the fuse are sandwiched. The walls form arc barriers which closely confront or contact the fuse wire on all four sides thereof ahead of the points where the fuse wire ends are connected to the terminals. These points of connection are advantageously out of alignment with the rest of the fuse wire. The terminals preferably extend from the confronting ends of the base and cover members where projections from the cover bearing on the terminals secure the terminals in place and seal the openings thereat.

22 Claims, 15 Drawing Figures

13
16
16
45
51
52
45
18
24
25
28
27
28
26
25
24
28
26
32
36
32
57
38
43
59
32
32
57
22
38
59
57
32
57
32
22
14
36
34

Fig 4
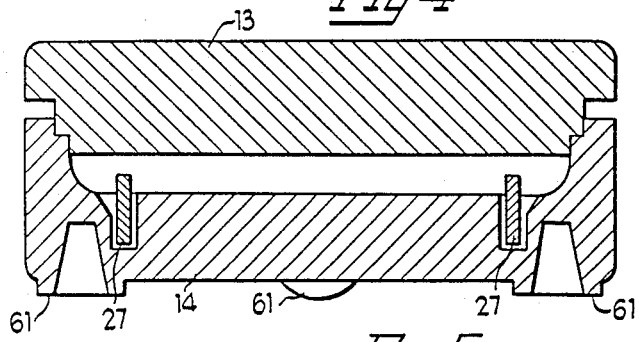
Fig 5
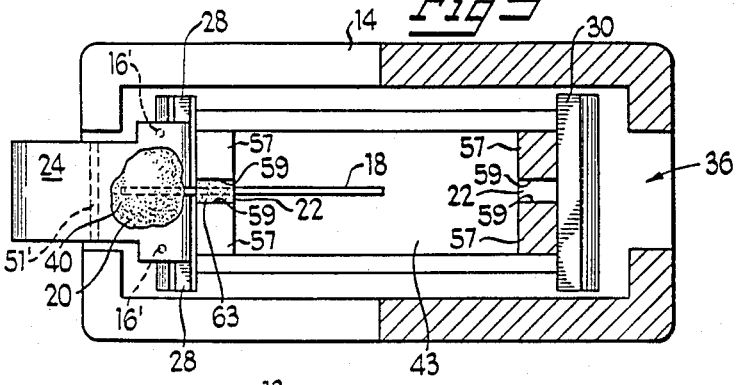
Fig 10
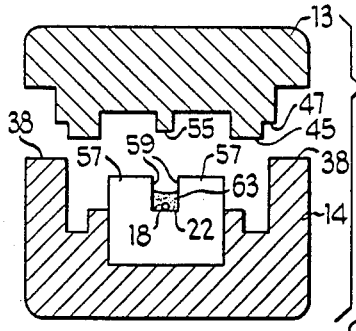
Fig 12
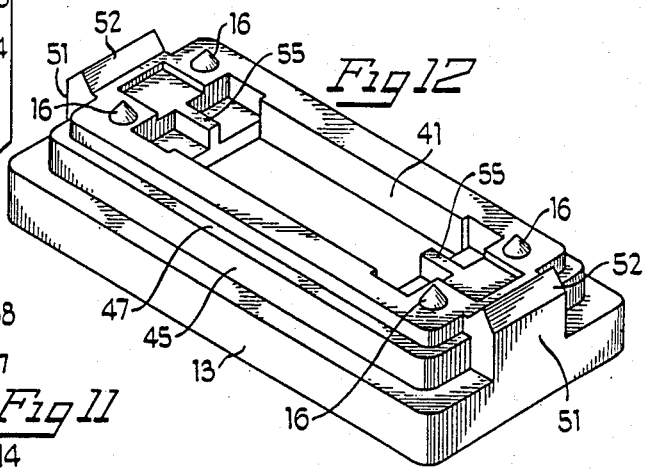
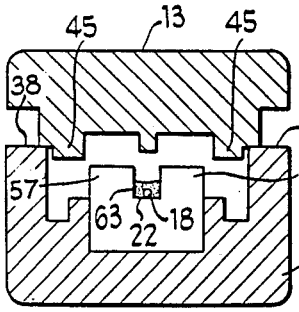
Fig 11

MINIATURE FUSE

DESCRIPTION

Technical Field of the Invention

The invention relates to miniature electrical fuses for use with circuit voltages of at least about 100 rms volts AC. While many aspects of the invention have a broader application, the most important application thereof is in miniature fuses to be mounted on printed circuit boards. At voltages as high as 250 volts the miniature fuses of the invention are generally less than one inch long, and preferably less than one half inch long for most current ratings and no greater than about one quarter inch wide.

BACKGROUND OF THE INVENTION

When a fuse blows, an arc is developed which, if it spreads to the metal surfaces of the fuse terminals, will vaporize the surface layer thereof and create fuse exploding pressures. In an AC circuit, the arc generally becomes extinguished as the AC current drops to zero and may not restrike or cause rupture of the fuse if the pressures and temperatures in the fuse cavity can be held within acceptable limits. As fuse structures are made progessively smaller, it becomes more difficult to keep these parameters within desired limits.

There is a need in the printed circuit art for fuses of substantial voltage rating, i.e. from 60 to 250 volts, and characterized by as small an overall dimension as possible. Such requirements are inherently in conflict, since a blowing fuse tends to generate rupture forces as a result of gas evolution and heating during the traveling of the arc along the fuse wire path and hence fuses capable of withstanding substantial restrike voltages during blowout typically must be fashioned with length greater than otherwise desired to allow the arc to extinguish and prevent rupture of the fuse casing. Should the casing rupture, there is an attendant fire hazard, as well as an attendant danger of damage to components on the printed circuit board itself. Printed circuit fuses should also have adequate protection against the entry of spray or dip solvents commonly used in the cleaning of printed circuit boards after final assembly of the components thereon.

To the applicant's knowledge, prior to the present invention there has not been designed a reliable sealed fuse much smaller than previous designs and capable of withstanding high energy fuse blowing conditions without destruction of the fuse housing. For example, there is a need for a reliable miniature printed circuit fuse which for a steady blowout current of 50 amps and 250 volts or equivalent energies can be made reliably as small as about 0.4 inches or less in overall length and even less in height and with a terminal spacing of the same dimension if desired (as when the terminals project axially from the fuse body ends and then bend downwardly). There has heretofore been developed cylindrical fuses with depending terminals within the boundries of the fuse and having a diameter of about 0.3 to 0.4 inches. The width of the fuses thus had to be greater than the terminal spacing and the height of the fuse was equal or greater than its width. Thus, at present, printed circuit fuses capable of withstanding such energies are relatively large, bulky fuses with cylindrical insulating bodies. Also such cylindrical fuses are too bulky for mounting on carrier strips wound on dispensing reels which can be conveniently inserted into automated machinery which automatically insert the fuses into the printed circuit board.

Other fuses used on printed circuit boards have fuse terminals which project from opposite axial ends of the body and terminate in parallel confronting terminal ends pluggable into socket openings in the printed circuit board, but these fuses when designed to accommodate the energies involved, have also been undesirably large. Since the general objective in printed circuitry is miniaturization, it is desirable that the fuse itself occupy as little space on the printed circuit board as possible.

It is frequently required of some low amperage fuses that they use fuse wire of very small diameter, such as the order of 0.0003 inches, for example. There is an inherent difficulty in fabricating fuses using such delicate fuse wires since the tensioning and positioning of such elements during delicate soldering operations is typically a manual operation resulting in substantial labor costs. Thus, an adequately miniaturized high voltage fuse of relatively low blowout current which could be manufactured inexpensively by automated methods would be a useful contribution to the art.

The prior art has used various techniques to increase the operating voltage of fuses by incorporating various techniques to increase the operating voltage of fuses by incorporating various arc quenching means therein. Thus, fuse elements have been surrounded by a suitable arc-quenching material. However, this approach is difficult to achieve in miniature fuses, or where very delicate fuse elements are used in the fuse. Another arc-quenching technique is to pass the portions of the fuse element immediately in advance of the points where they are soldered to the fuse terminals through restricted openings or grooves in the insulating material of the body involved, as shown by the fuse construction of U.S. Pat. No. 4,267,543, granted to Arikawa. This patent discloses a fuse structure employing a fuse element spanning a cavity defined between D-shaped insulating arc barrier-forming bosses in a cylindrical base portion of the fuse. The bosses are slotted to receive the fuse element and have recesses to receive and expose the terminals of the fuses to which the fuse element ends are soldered. A rigid cover overlies the base portion of the fuse. However, it is believed that the fuse design is inadequate to withstand without rupturing the pressures and temperatures present in a 250 volt circuit when made with less than 0.4 inch exposed to arcing terminal separation. Furthermore, because the circuit plug in terminals are spaced parallel pins, the overall size of such a fuse would be much greater than the terminal spacing.

SUMMARY OF THE INVENTION

The invention deals with, among other things, an arc propagation suppression system which increases the voltage rating of fuses of short overall length, which is useful when desired in printed circuit application. In the preferred embodiment of the invention, such a fuse features preferably a rectangular base having conducting terminal members with inner fuse wire attachment contact surfaces located inwardly of the ends of the base. The fuse wire preferably extends tautly between these surfaces. Each of these terminal members have a first outer end portion projecting axially from a different end of the base, and a second outer end portion folded downward so that the outermost end portions of the terminal members extend in parallel confronting relation, particularly configured for insertion into the terminal-receiving openings of a printed circuit board on which the fuse is rigidly supported. To simplify further description, the fuse will be described as though the fuse were mounted on top of a printed circuit board generally horizontally disposed.

According to a feature of the invention the fuse wire extends across a cavity-forming recess in the base and then along insulating surfaces on the opposite sides of the recess base. These surfaces include a pair of upstanding transverse ribs disposed close to the fuse wire terminal attachment points. The insulating surfaces of the ribs are slightly raised above these attachment surfaces of the terminals so as to lightly tense the fuse wire at two points immediately proximate to the attachment surfaces. By this means masses of insulating material (the top faces of the ribs) are in intimate contact with the end portions of the fuse wire in advance of their points of contact with the terminal members.

According to a related feature of the invention, each rib is preferably provided with a pair of further upwardly extending insulating rib-like projections disposed on opposite sides of the fuse wire to form at least a three-wall confining shroud further confining and therefor further quenching a propagating arc. According to a further related feature, an insulating cover is provided which is sealable to the base member to provide a spray-resistant seal thereto, said cover being configured with inwardly extending projections configured to engage, or to be in close but spaced relationship to, each rib structure and fuse wire lying thereon to provide a fourth wall for forming complete arc confining shrouds about the fuse wire. Alternatively, the cover may be configured also to provide said rib-like projections to provide the same arc-confining action.

Three advantages are secured from this configuration. First, a blowout arc propagating towards the fuse wire attachment points must pass over the support ribs, which are preferably chosen to be of a material which provides a quenching action to an arc propagating in contact therewith. Second, by tensing the fuse wire against the supporting ribs, more uniform thermal characteristics are imparted to the structure than are obtained by simply laying a fuse wire across insulating regions which are coplanar with the attachment regions, as is shown in U.S. Pat. No. 4,267,543 (Arikawa). Such coplanar arrangements give rise to variable degrees of thermal contact between the fuse wire and the insulating regions, resulting in variations in fuse blowout current values in those cases where the fuse current approaches the nominal blowout value relatively slowly. Third, by offsetting the attachment regions from the fuse wire axis, these regions are not in line-of-sight with the arc during initiation of high voltage-high current blowout, a feature which appears to improve the resistance of the fuse to explosive rupture, apparently by a form of shielding action which makes it more difficult for the arc to reach the relatively massive conducting attachment regions. This feature is also absent from the above-mentioned Arikawa patent.

United Kingdom Pat. No. 517,153 (Marston, et. al.) shows a low voltage (e.g. 12 volt) automotive fuse, which is not a miniature fuse operating at voltages like 60 to 250 volts, and illustrating the problems overcome by the present invention. The fuse disclosed in this patent has complementary housing shells 1, 2 captively sandwiching end terminals 5—5 and the ends of a fuse wire therebetween. Even if this patent were to be considered relevant art to the high voltage fuse of the present invention, there would still be no teaching of offsetting the end terminals from the fuse wire axis or providing the enclosing rib structure described for enclosing at least 3 and preferably all of the sides of the fuse wire ends found desirably in miniature fuses. Also, the pressure of the two halves of the housing upon the fuse wire sandwiched therebetween is possibly damaging to a fragile fuse wire.

The present invention is also to be contrasted with the arc-confining structures shown in U.S. Pat. No. 3,913,051 to Manker et. al. which discloses a miniature fuse comprising a body of insulating material having a small depression or well formed therein and having a fuse element spanning the well and resting upon metallized support surfaces on the body beyond the well. A pair of terminals have inner ends which overlie and are secured by solder joints to the end portions of the fuse elements. Shrink tubing tightly envelops this entire assembly to seal the fuse interior, in particular forming a tight confinement about the terminal portions of the fuse wire. Although the terminal portions of the fuse wire are thus held in strong contact against the fuse holder body, nevertheless as the propagating arc enters this region, it would routinely be expected that the heat of the arc would locally melt the shrink tubing. This would have the effect of expanding the tubing immediately about the arc, with the result that, not only would the quenching action be substantially reduced, but there would also be a concomitant possibility of explosive and possibly dangerous rupture of the assembly. Similarly, U.S. Pat. No. 3,291,939 to Hitchcock shows the use of a resilient sleeve surrounding a fuse element which is passed diagonally through an opening in an insulating printed circuit board and diagonally supported between the two ends of copper coatings on opposite faces of the board. The purpose of this sleeve is to localize the traveling arc during burnout to a narrow channel proximate to either surface of the printed circuit board and comprising the end terminals of structure, so as to provide "a significant elongation of the arc and significant increase of the arc voltage at a period of time following arc initiation rather than at the time of arc initiation." Here, substnatially the same arc-confinement means as exhibited by the Manker reference is employed, and similarly suffering from possible loss of confinement and explosure rupture of the structure as the arc actually enters the confining region.

According to one preferred embodiment of the invention, the terminal members exit the ends of the base through a cut-out in the upstanding walls surrounding the periphery of the base at the ends thereof, and the cover is configured with a downwardly extending blade-like extension thereof, having an energy director at the ends, so that the cover may be ultrasonically welded to the base and all points along the peripheral walls thereof, as well as to the upper surface of each terminal member, thereby holding energy transfer to the terminal member at a minimum, while at the same time providing a spray-resistant seal around the entire structure.

According to a related feature of the invention, the base of the housing is configured for axial lay-in insertion of a length of fuse wire of arbitrarily long length with respect to the major dimension of the fuse, so that fuse wires may be soldered in place along a continuous string of such base members during manufacture, thereby minimizing handling and positioning of delicate fuse wires.

According to a still further feature of the invention, the interior annular regions of the upstanding peripheral walls of the base member are provided with an interior annular groove, and the cover is configured with downwardly extending portions of complementary configuration, so that ultrasonic fusion during the sealing of the cover to the base member occurs along a restricted area interface, and so that ultrasonic energy transmitted to the fuse wire during the sealing operation is held to an absolute minimum to minimize wire vibration and possible breakage.

The fuses disclosed are characterized by ease of manufacture, substantially improved yield in the handling and manipulation of delicate fuse wires when making low amperage fuses, and greater arc-quenching capabilities at high voltages for a given fuse length.

Other advantages and features of the invention will become apparent upon making reference to the description to follow, the drawings and the claims.

DESCRIPTION OF THE DRAWINGS

FIG. 4 is a cross section view of the fuse assembly of FIG. 1.

FIG. 5 is a partially sectioned top view of a partially assembled base assembly as indicated by the offset cut lines in FIG. 3.

FIGS. 10 and 11 are cross-section views of the fuse holder of FIG. 1, showing the cap immediately before and after placement respectively, and prior to the welding together thereof;

FIG. 12 is a perspective bottom view of the cover for the fuse of FIG. 1;

DETAILED DESCRIPTION OF THE INVENTION

Figure 1:
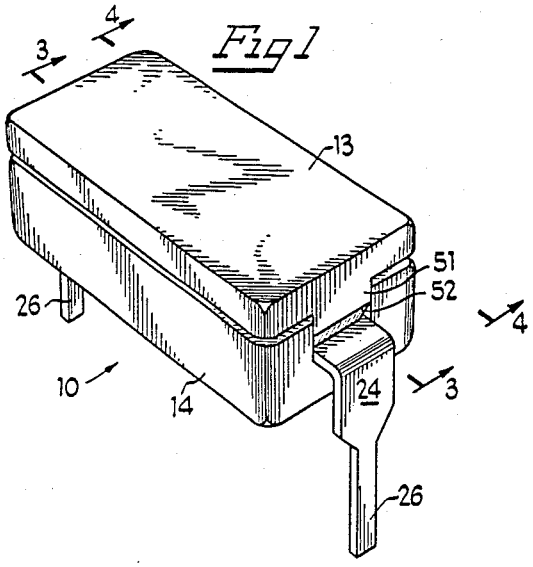
FIG. 1 is a perspective view of a fuse assembly.
Figure 2:
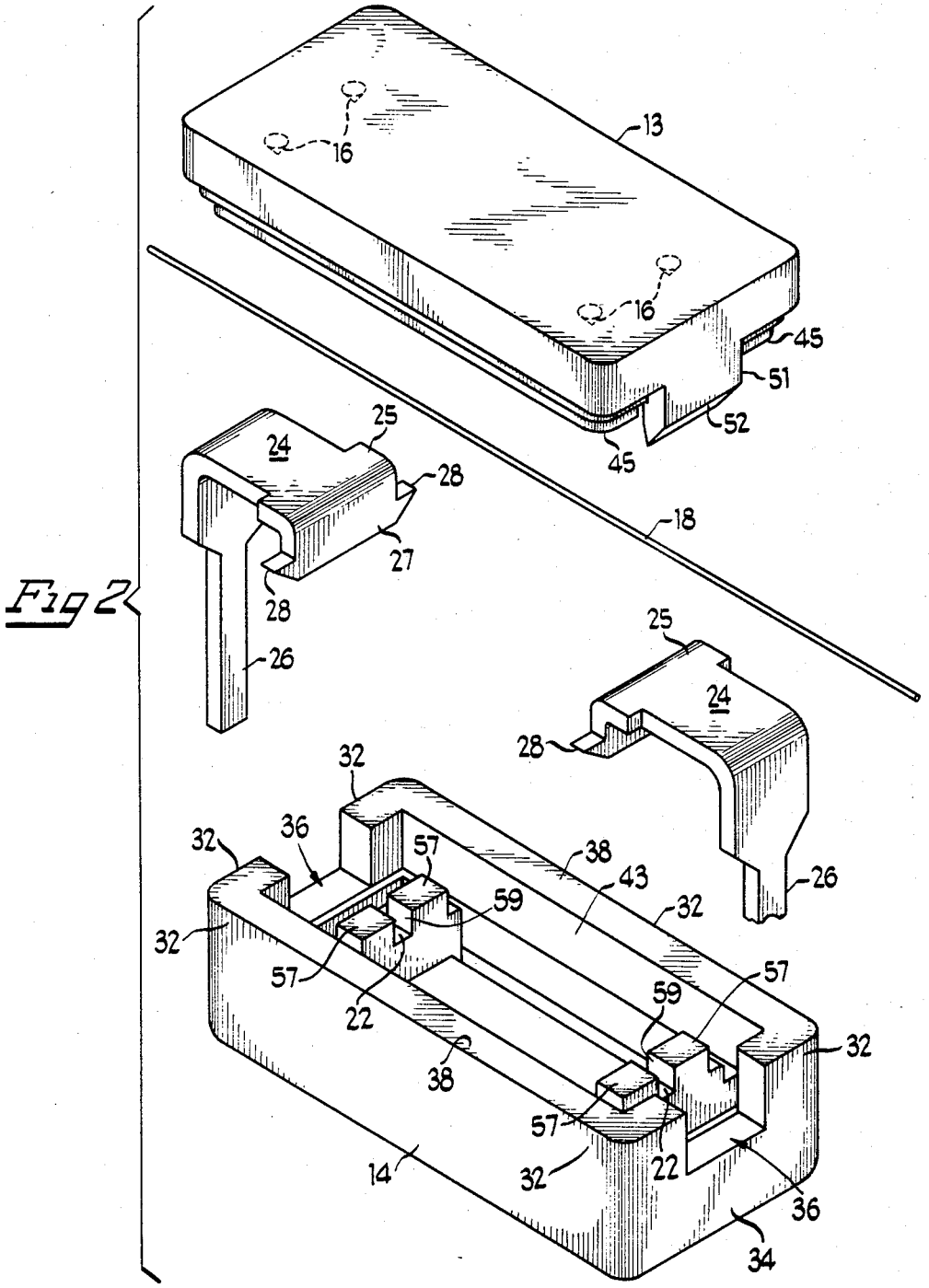
FIG. 2 is an exploded assembly view of the fuse assembly of FIG. 1 showing a base member, two terminal members, a length of fuse wire, and a sealing cap.

FIG. 1 shows an assembled fuse adapted for printed circuit board mounting, the fuse as shown being one embodiment of the subject matter of the invention. The fuse 10 consists of a housing including a generally rectangular base 14 having a sealing cover 13 affixed thereto, terminal members 24 exiting axially from the ends and folded generally downward as shown in the figure to present lead portions 26 projecting generally parallel for insertion into a printed circuit board. FIG. 2 is an exploded view showing the components of the fuse of FIG. 1.

Figure 3:
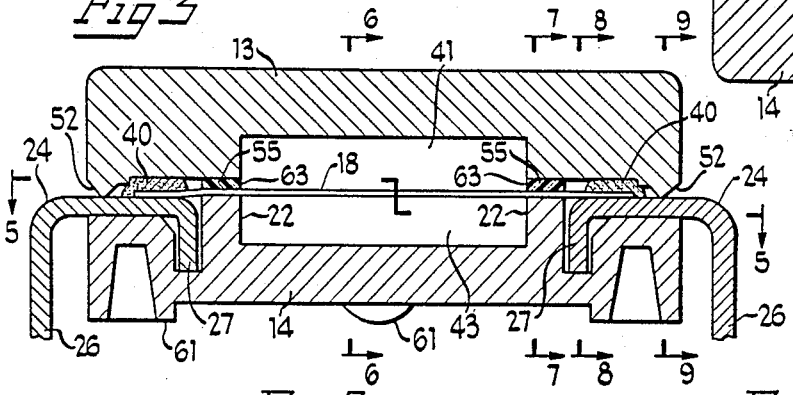
FIG. 3 is a cross-section side view of the fuse assembly of FIG. 1.

FIG. 3 shows the arrangement of internal components after assembly. The terminal members 24 are configured with parallel planar contacting portions 25 (see FIG. 2) and downwardly facing retention ends 27 carrying engaging barbs or projections 28 adapted to engagingly fit into base slots 30 (see the partial assembly view shown in FIG. 5), so that by pressing insertion of the ends 27 into the base slots the terminals are retained sufficiently securely that the remainder of the assembly operations may be carried out. The inserted terminal members 24 exit the peripheral walls 32 of the base 14 through end openings 36 (FIG. 2). A length of fuse wire 18 is then laid over and in contact with the contacting regions 25 of the inserted terminal members 24, the wires being secured in position most preferably by a solder drop 20 (FIG. 5).

Referring to FIG. 3, and, as shown more clearly in FIG. 2, it will be noted that a raised rib 22 integral with the base 14, is disposed to bear against the fuse wire 18, so that the soldered fuse wire after soldering is in tension engagement against this base rib. The base rib 22 and as will subsequently be discussed, additional surrounding ribs, serve by their close proximity to or contact with the fuse wire 18 to inhibit the propagation of arcs formed along the fuse wire during blowout, so as to prevent arc propagation into contact with the massive contacting regions 25 of terminal members 24. Such a condition is well known in the art to be conducive to catastrophic explosive rupture of the fuse housing, resulting in danger to nearby components, as well as presenting a general fire hazard. In this respect, it will be noted (FIG. 2) that two upstanding base shroud-forming ribs 57 are disposed on either side of the base rib 22, presenting interior walls 59 in proximate to the fuse wire 18, as shown in FIG. 5. Thus the base 14 places three shroud elements proximate to the fuse wire 18.

With the fuse wire 18 soldered in place, the cover 13 is lowered over the base 14, the cover having a downwardly extending ridge 45 adapted to match the interior contours of base walls 32, the insertion thereof terminating by engagement of the upper surfaces 38 of the base walls with a step 47 (FIG. 10) in the ridge. By application of ultrasonic energy through the cover 13, an interfacial melting occurs at the interface formed between the top surface 38 of the base walls and the step 47, with the result that the cover settles downward with such modest vibration forces that very thin and fragile fuse wires will generally not be damaged thereby.

FIGS. 10 and 11 show the initial sequence of cover assembly before welding. In order to minimize the amount of accoustical energy necessary to effect sealing, the width of the step 47 in the ridge 45 is kept deliberately small, thereby also minimizing the total vibration transfer area of the structure. As just indicated, such vibration transfer precautions are necessary, particularly when dealing with extremely small fuse wires as 0.0003 inches in diameter, in order to prevent resonant wire breakage.

To secure the terminal members 24 in the base 14, conical energy directors 16 are disposed in the cover 13 as shown in FIG. 2 and FIG. 12 to press against the planar contacting regions as shown in dotted outlines 16' in FIG. 5. Additionally, a pair of energy director blades 51 having tapered ends 52 are disposed to lie over the end openings 36 and to pressingly engage the region shown by the dotted outlines 51' in FIG. 5.

Figure 8:
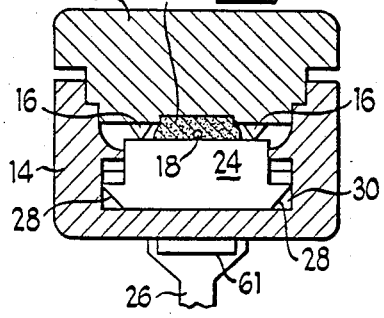
Figure 9:
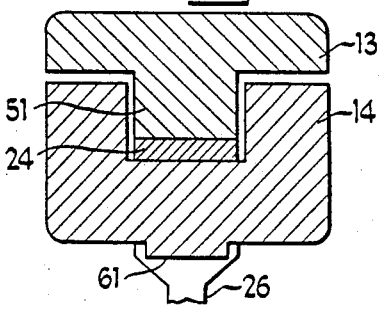

The energy director elements 16 and 51 are dimensioned sufficiently short that during the initial engagement of the cover 13 with the base 14 (FIG. 10), they make no contact with the terminals 24. As the cover 13 settles into the base 14 during the ultrasonic welding operation, ultimately the energy directors 16 and 51 come into contact with the terminal members 24 in the regions marked 51' and 16' in FIG. 5, to cause slight local melting and minimal energy transfer to the base 14 and to the fuse wire 18, thereby minimizing the possibility of fuse wire breakage. FIGS. 8 and 9 showing cross section views of the engagement of the energy directors 16 and 51 with a terminal member 24.

Figure 6:
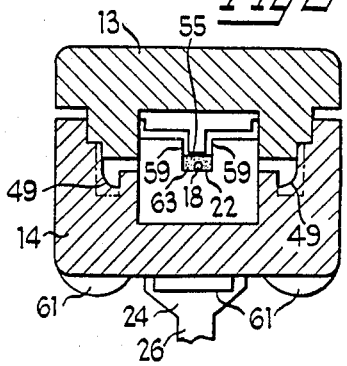
FIGS. 6–9 are various cross-section views of the fuse assembly of FIG. 1 sectioned as indicated in FIG. 3.

At this point the ultrasonic energy application is terminated, yielding the structure shown in FIG. 6 with the cover 13 sealed to the base 14 primarily at the interfacial step 47 (FIG. 10), and with the energy directors 16 and 51 locally melted to a small degree to pressingly engage and seal the terminal members 24 in position. The director blades 51 (see FIG. 1) serve to provide a sealing action against liquid solvent sprays used in the vicinity of the fuse during subsequent printed circuit manufacture.

It will also be evident to those skilled in the art that higher amperage fuse elements may be used than the indicated examplary small filamentary fuse wire 18, as for example a fuse element in the form of a ribbon. In such cases fragility of the fuse element does not pose the severe requirements on vibration during cover welding, and in such a case the cover may be welded until the cover shroud 55 physically contacts the fuse ribbon to terminate further downward movement of the cap.

As shown in FIG. 3, the cover 13 and the base 14 are each provided with respective matching half-cavities 41 and 43 between the base ribs 22, thereby providing a substantial gas expansion volume around the fuse wire 18, so as to minimize the explosive effects of the fuse arc. It will be seen from FIG. 12 that a pair of integral cover shrouds 55 are provided on the cover 13, the shroud elements being configured to insertingly fit within the walls 59 disposed on either side of the base rib 22 during cover assembly. This arrangement is best shown in the cross section view of FIG. 7.

Figure 7:
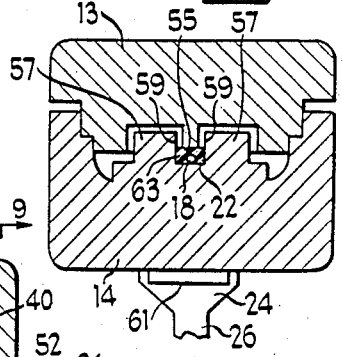

Thus, in the assembled fuse the fuse wire 18 is in pressing engagement with the base rib 22, and is surrounded in close proximity by three complementary interior walls 59-59-55. Although drawn in the various figures as having substantial separation, it should be appreciated that the interior base shroud walls 59 may be placed quite close to each other to provide additional confinement to the propagating arc during blowout, thereby contributing materially to the arc quenching action. It is a general rule in such structures, that the more insulating material is brought into close proximity with the fuse wire, the better the quenching action, and hence the higher the possible voltage rating for a given overall fuse dimension. By configuring both the base and the cover to form an interlocking completely surrounding shroud as shown in FIG. 7, a substantial reduction in necessary overall fuse length is achieved, thereby making the fuse 10 of FIG. 1 particularly suitable for miniature applications in printed circuit boards, especially for 60 volt applications wherein a power supply input power line must be fused.

Although the four shroud walls consisting of elements 22, 59, 59 and 55 are disclosed in close proximity to the fuse wire 18, and yield a substantial quenching action by their close proximity to the fuse wire and thus a general constricting action on the arc passage, additional improvement in fuse quenching may optionally be secured by placing a small quantity of liquid curable insulating material, such as self-vulcanizing silicone rubber, over the rib 22 immediately prior to cap assembly, by which means a total sealing action about the fuse wire 18 is secured, with no air space between the fuse wire and any of the four surrounding walls. The intimate contact of the silicone rubber with the fuse wire 18 thus provides a more efficient encapsulation, with the four surrounding walls providing an insulating unyielding backing to serve to confine the silicone rubber from being blown out of position by the travelling arc.

The rigid surrounding support provided to such a quenching agent by the four rigid elements 22, 59, 59, and 55 is to be compared with the previously mentioned limitations of the use of a simple resilient or shrinkable sleeve securing the fuse wire in contact with the fuse holder body as discussed in the Summary of Invention with respect to the Manker and Hitchcock patents.

An additional blowout protection measure is employed as shown in FIG. 3, wherein another small quantity of silicone rubber is employed as a small pool 40 over the ends of the fuse wire 18 to serve as an additional quenching element in the immediate vicinity of the terminals 24.

In addition to improved quenching capability for a given overall fuse size, and hence an improved voltage capability for that size, the fuse 10 is uniquely adapted to mass fabriction of fuses of very low current range, in which extremely fine fuse wires 18 must be employed. As shown in FIG. 2, it is clear that the fuse wire 18 may be dispensed under very light tension from a dispensing spool (not shown) to be lightly flexed over the rib 22 and then soldered to the contacting regions 25 of the terminal members 24. It should further be noted, that before trimming off excess fuse wire 18 after the soldering operation, the entire assembly may then be moved with the fuse wire attached to both terminals 24 along the general axis defined by the extended fuse wire 18 shown in FIG. 2, whereby the motion of the partially assembled fuse serves to carry the fuse wire in the indicated direction in a lightly tension condition, in which case a second assembly may be lifted into contacting position below it to be soldered to the still tensioned length of fuse wire, after which time the excess fuse wire may be trimmed from the first fuse, the first fuse then being finally assembled. In short, by allowing for general axial extension of the fuse wire 18 beyond the limits of the base 14 by providing the passages 36, the design shown in FIG. 2 lends itself to completely automatic handling of very delicate fuse wires in a mass production system. It is well known in the art that the positioning and soldering of delicate fuse wires is a tedious and therefore expensive operation.

It will be evident to those of ordinary skill in the art that the terminal members 24 may be integrally molded with the base 14 during fabrication of the base, and thus the hold-down energy director 16 on the cap 13 would not be necessary to hold the base terminal in place. It is equally evident that the lead attachment portions 26 of the end terminals 24 could be brought directly out through the bottom of the base member 14, and would not extend through the end passages 36 as shown, for example FIG. 13. In such an arrangement, however, the sealing blades and energy directors 51 and 52 would have to be retained as a sealing feature in order to allow the previously mentioned mass fabrication technique to be employed, because an unobstructed passage of the fuse wire 18 over the contacting terminals 24 and through the end passages 36 is central to the particular mode of mass fabrication described.

Figure 13:
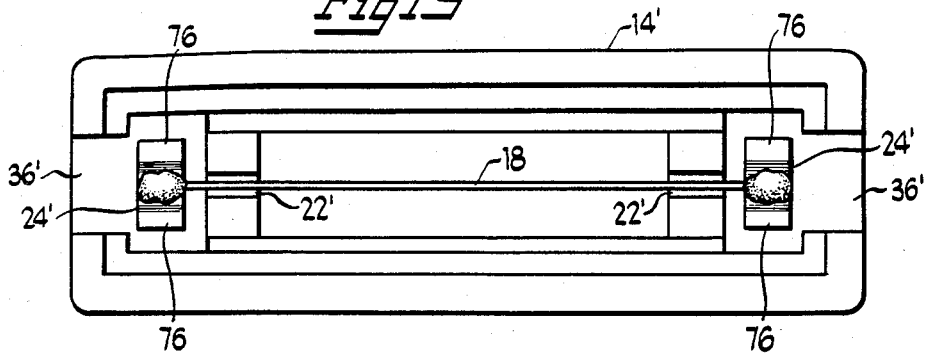
FIG. 13 is a plan view of a modified base member having modified end contacts, showing the fuse wire soldered into position.
Figure 14:
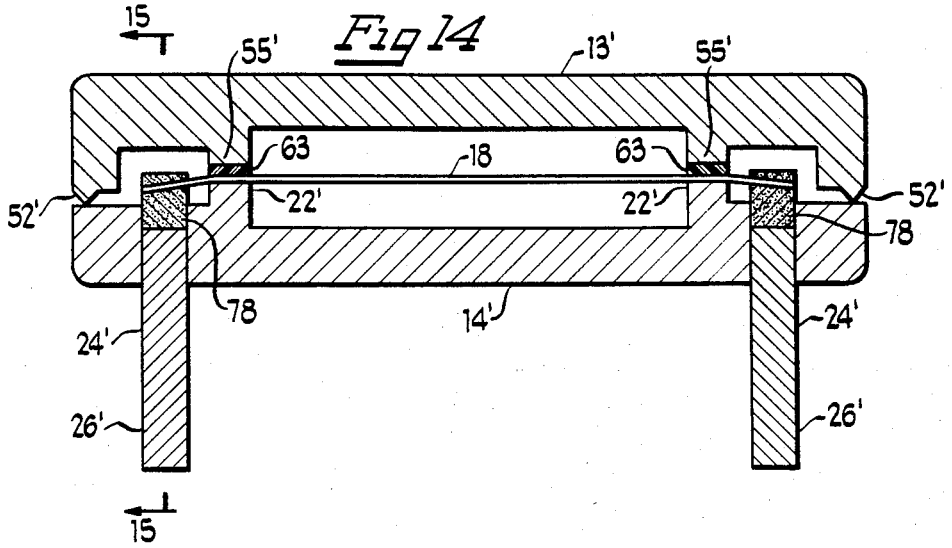
FIG. 14 is a center cross sectional view of the assembled base of FIG. 13 and the cover of FIG. 12, showing the fuse wire captively secured in a modified end terminal having a centering crotch therein.
Figure 15:
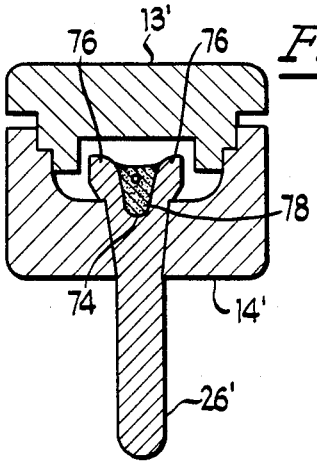
FIG. 15 is a cross-section side view of the assembled fuse of FIG. 14.

FIGS. 13-15 show an alternative embodiment wherein modified terminals 24', having upstanding ears 76 defining a crotch 74, are either press fitted or integrally molded into a base 14' to extend out the bottom thereof. The ears 76 serve to captively center a laid in fuse-wire 18 during assembly, the fuse wire being secured into the crotch 74 of each terminal 24' by melting of a solder 78, typically applied in the form of a paste solder cream. As in the previously described embodiment, end passages 36' provided in the base 14' are provided for mass production fuse wire insertion, the cover sealing the end passages 36' by means of a pair of complementary director blades 51 as before. The interior shrouding of the fuse wire 18 is unchanged.

The crotch type terminal 24' is to be preferred for certain types of slow-blow fuse wires involving a ceramic fuse wire filament matrix, to which conventional soldering operations have proven to be difficult. By providing for a well in the form of a crotch 74, a substantial pool of solder 78, held in place by surface tension, effectively surrounds the entire fuse wire 18 to insure adequate electrical contact thereto.

Thus, there has been described a fuse particularly adapted to the mass fabrication of 60 to 250 volt fuses, and in particularly low amperage high voltage rating fuses. By providing for integral constricting shroud members in both base and cover an insulating contriction is formed at both ends of the fuse wire to supress explosive rupture of the fuse on blowout. By insertion of an optional curable liquid quenching agent within the shroud constriction a further surpression of arc propagation is achieved. By properly positioning and dimensioning the energy director elements whereby the cover is ultrasonically welded to the housing base, the energy transfer to the fragile central fuse wire is effectively minimized, while still providing not only adequate sealing, but improved retention of the contacting terminals.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A miniature electrical fuse for use with a circuit voltage of at least 60 volts comprising:

a housing comprising an insulating base defining a cavity-forming depression thereon opening onto the top or inner side thereof and presenting a pair of insulating surfaces on opposite sides of said depression and a cover enclosing the top of said base;

a pair of electrically conducting terminals mounted on said base beneath said cover, each terminal having a fuse wire-receiving inner end portion on said base and an outer end portion extending away from said base; and a length of fuse wire extending generally along said insulating surfaces where it spans said depression and extends beyond the outer ends of said surfaces, said inner end portions of said terminals being disposed in planes below the outer ends of said insulating surfaces so as to be out of alignment therewith and so that the fuse wire tautly extends over the outer ends of said insulating surfaces and then makes connection to said inner end portions of said terminals.

2. The fuse of claim 1 wherein each of said insulating surfaces is formed by the top surfaces of rib means projecting separately from said base.

3. The fuse of claim 1 wherein there is provided on opposite sides of said insulating surfaces arc-barrier-forming insulating wall means closely confronting the opposite lateral sides of said fuse wire thereat.

4. The fuse of claim 3 wherein said insulating wall means extend from said base.

5. The fuse of claim 3 wherein said cover has arc barrier-forming wall means on the bottom thereof closely spaced from the top of said fuse wire opposite that portion of said insulating surfaces against which said fuse wire bears.

6. The fuse of claim 1 wherein said outer end portion of said terminals leave the fuse along the longitudinal axis thereof and between confronting faces at the ends of said cover end base.

7. A miniature electrical fuse for use with a circuit voltage of at least 60 volts comprising:

a housing comprising an insulating base defining a cavity-forming depression thereon opening onto the top or inner side thereof and presenting a pair of insulating surfaces on opposite sides of said depression and a cover enclosing the top of said base;

a pair of electrically conducting terminals mounted on said base beneath said cover, each terminal having a fuse wire-receiving inner end portion on said base and an outer end portion extending away from said base; and a length of fuse wire extending generally along said insulating surfaces where it spans said depression and extends beyond the outer ends of said surfaces; arc-barrier-forming insulating wall means closely confronting the opposite lateral sides of said fuse wire on opposite lateral sides of said pair of insulating surfaces, and said cover has arc barrier-forming wall means on the bottom thereof closely spaced from the top of said fuse wire opposite that portion of said insulating surfaces.

8. The fuse of claim 7 wherein each of said insulating surfaces is formed by the outer surfaces of rib means projecting separately from said base.

9. The fuse of claim 7 wherein said insulating wall means extend from said base.

10. The fuse of claim 7 wherein said outer end portion of said terminals leave the fuse along the longitudinal axis thereof and between confronting faces at the ends of said cover end base.

11. The fuse of claim 1 or 7 wherein the inner end portion of each terminal is configured as a pair of upwardly extending ear members each defining a crotch therebetween, said crotch receiving an end of said fuse wire laid therein and secured thereto by solder or the like placed in the crotch.

12. In a miniature electrical fuse for use with a circuit voltage of at least 60 volts comprising a housing comprising an elongated insulating base defining a cavity-forming depression thereon opening onto the top or inner side thereof, a pair of electrically conducting terminals mounted on the ends of said base beneath said cover, each terminal having a fuse wire-receiving inner end portion on said base and an outer end portion longitudinally extending away from said base and a length of fuse wire disposed generally along the long dimension of said base and attached at its ends to said inner end portions of said terminals; the improvement wherein the confronting portions of said base and said cover are configured to form insulating constrictions disposed about an intermediate portion of said fuse wire just in advance of the inner end portions of said terminals, each said constriction comprising at least four arc barrier-forming insulating walls closely confronting all sides of said fuse wire, at least the wall on the cover side thereof being spaced from said fuse wire.

13. The fuse of claim 12 wherein in each said constriction said base contacts said fuse wire immediately in advance of the point where it is attached to said terminals.

14. The fuse of claim 12 wherein all of said walls are solid, rigid walls of insulating material.

15. The fuse of claims 1, 7 or 12 wherein said base is provided with upstanding peripheral walls for engagingly supporting said cover, said cover having disposed thereon a matching complementary ridge extending downwardly therefrom to engage said walls along upper surfaces thereof along a step in said ridge, said cover further having disposed thereon a plurality of downwardly extending downwardly converging ultrasonic energy director elements disposed to touchingly engage portions of each of said terminals when said cover is secured to said base, the vertical length of said step on said ridge configured such that application of ultrasonic energy to said cover to fuse said cover to said base member causes initial melting only within said step, so as to cause said cover to settle until said energy director elements engage said regions of said terminals to captively secure said terminals to said base member.

16. The fuse of claim 1 or 7 wherein said outer end portions of said terminals exit said base through openings in said peripheral walls thereof, and said cover has a pair of said energy director elements configured in the form of downwardly extending blades disposed to fit within each of said base openings, so that said blades engage said terminals to seal said walls and pressingly secure said terminals to said base.

17. The fuse of claims 1 or 7 wherein said base is provided with upstanding peripheral walls for engaging said cover, said walls having vertically disposed slot-formed end passages through said walls to allow a length of said fuse wire longer than said base member to be insertingly laid down through said passages to contact said contacting portions of said terminal members for attachment thereto, and wherein said cover is provided with a pair of blade-like sealing members of configuration complementary to said end passages to provide a seal thereat.

18. The fuse of claims 12 further comprising a plug of resilient arc-quenching material in adherent contact with said four walls and said fuse wire.

19. A miniature electrical fuse for use with a circuit voltage of at least 60 volts comprising: a housing comprising an insulating base defining a cavity-forming depression thereon opening onto the top or inner side thereof and a cover enclosing the top of said base, a pair of electrically conducting terminals mounted on said base beneath said cover, each terminal having a fuse wire-receiving inner end portion on said base and an outer end portion; a fusible element connectively attached at the ends thereof to form a circuit between said terminal portions; said base being provided with upstanding peripheral walls for engagingly supporting said cover, said cover having disposed thereon a matching complementary ridge extending downwardly therefrom to engage said walls along upper surface thereof along a step in said ridge, said cover further having disposed thereon a plurality of downwardly extending downwardly converging ultrasonic energy director elements disposed to touchingly engage portions of each of said terminals when said cover is secured to said base, the vertical length of said step on said ridge configured such that application of ultrasonic energy to said cover to fuse said cover to said base member causes initial melting only within said step, so as to cause said cover to settle until said energy director elements engage said regions of said terminals to captively secure said terminals to said base member.

20. The fuse of claim 18 wherein said outer end portions of said terminals exit said base through end openings in said peripheral walls thereof, and said cover has a pair of said energy director elements configured in the form of downwardly extending blades disposed to fit within each of said base openings, so that said blades engage said terminals to seal said walls and pressingly secure said terminals to said base.

21. In a fuse having a body of insulating material having a cavity therein opening onto at least one longitudinal side surface of the body, a pair of conductive terminals secured within opposite end portions of the body and having conductive fuse element attachment surfaces forming conductive extensions at inner ends of said terminals beyond the margins of said cavity and between which a fuse element is connectively attached, the body having a pair of fuse element-receiving grooves extending from opposite ends of said cavity toward the ends of said body and said attachment surfaces, and an insulating enclosure closing off the cavity and other openings in said body so as to enclose the fuse element, the improvement wherein said fuse element attachment surfaces are located out of alignment with and beyond said grooves so that a fuse element in the bottom of said grooves must bend around the ends of the grooves to make connection with the fuse element attachment surfaces; and there is provided a fuse element extending across the cavity and along the bottom of the grooves and bending abruptly around the groove ends where end of said fuse element are secured to said fuse element attachment surfaces.

22. In a fuse having a body of insulating material having a cavity therein and opening onto at least one longitudinal side surface of the body, a pair of conductive terminals secured within opposite end portions of the body and having conductive fuse element attachment surfaces forming conductive extensions at the inner ends of said terminals beyond the margins of said cavity, the body having a pair of fuse element-receiving and drop-in grooves extending from opposite ends of said cavity toward the ends of said body and said attachment surfaces, said grooves being initially open along said one longitudinal side of said body for their full lengths to enable a fuse element to be conveniently placed into the grooves, a fuse element extending across the cavity along the bottoms of said grooves and having end portions secured to said fuse element attachment surfaces, and an insulating enclosure closing off the cavity and other openings in said body so as to enclose the fuse element, the improvement wherein insulating material is placed in the path of said grooves and on the outside of said fuse element and located at points in advance of the points of said attachment of said fuse element to said fuse element attachment surfaces, so that the defining walls of said grooves and insulation material in the path of said grooves outside of said fuse element form arc-confining and quenching barriers surrounding all sides of the fuse element.

* * * * *